US008689782B2

(12) United States Patent
Padgett

(10) Patent No.: US 8,689,782 B2
(45) Date of Patent: Apr. 8, 2014

(54) SIMMER PLATE ATTACHED TO BURNER

(75) Inventor: Michael Padgett, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 531 days.

(21) Appl. No.: 12/956,328

(22) Filed: Nov. 30, 2010

(65) Prior Publication Data

US 2011/0290231 A1 Dec. 1, 2011

Related U.S. Application Data

(60) Provisional application No. 61/265,004, filed on Nov. 30, 2009.

(51) Int. Cl.
*F24C 15/10* (2006.01)

(52) U.S. Cl.
USPC ..... 126/215; 126/211; 431/278

(58) Field of Classification Search
USPC ..... 126/211, 215; 431/278
See application file for complete search history.

(56) References Cited

U.S. PATENT DOCUMENTS

| | | | | |
|---|---|---|---|---|
| 4,626,196 | A * | 12/1986 | Stohrer, Jr. | 431/264 |
| 5,639,232 | A | 6/1997 | Bogenschutz et al. | |
| 6,780,008 | B2 | 8/2004 | Koch et al. | |
| 7,661,954 | B2 * | 2/2010 | Harneit | 431/278 |
| 2004/0234915 | A1 * | 11/2004 | Koch et al. | 431/278 |
| 2006/0024632 | A1 | 2/2006 | Sanchez | |
| 2006/0063119 | A1 | 3/2006 | Molla | |
| 2007/0218414 | A1 | 9/2007 | Harneit | |
| 2009/0165777 | A1 * | 7/2009 | Cadima et al. | 126/39 E |

OTHER PUBLICATIONS

International Search Report for PCT/US2010/058313, dated Mar. 1, 2011, 2 pages.

* cited by examiner

*Primary Examiner* — Kenneth Rinehart
*Assistant Examiner* — Gajanan M Prabhu
(74) *Attorney, Agent, or Firm* — Pearne & Gordon LLP

(57) ABSTRACT

A gas burner includes a burner body and a simmer plate assembly. The burner body includes a central cavity in which at least one flame is provided. The simmer plate assembly includes a plate portion and a base portion configured to support the plate portion. The assembly is configured to be at least partially and removably inserted into the central cavity. The plate portion is configured to act as a barrier between the at least one flame and a heated object placed above the gas burner.

20 Claims, 5 Drawing Sheets

SIMMER PLATE ATTACHED TO BURNER

CROSS-REFERENCE TO RELATED APPLICATIONS

This application claims the benefit of U.S. Provisional Application No. 61/265,004, filed Nov. 30, 2009, the entire disclosure of which is incorporated herein by reference.

FIELD OF THE INVENTION

The present invention relates generally to combustible gas burners, and more particularly, to combustible gas burners that include simmer plates.

BACKGROUND OF THE INVENTION

Gas burners such as gas surface burners, for example, that are used with domestic gas ranges typically include a burner body or head that includes a plurality of burner ports through which a combustible gas is distributed to the exterior of the burner body. A burner cap can be provided at the top of the burner body so as to close off the interior of the burner body to the escape of the combustible gas. Usually a mixing conduit introduces a mixture of a gaseous fuel and air as the combustible gas into the burner body. The gas-air mixture can be confined in combustible gas plenum within the burner body that is closed off by the burner cap. From the plenum, the combustible gas typically passes through the burner ports and is ignited by an igniter and burned. Often times the burner body has a circular configuration so that a ring of discrete flames emanating from the burner ports is established. The gaseous fuel typically comprises natural gas (which is primarily methane), propane, butane or mixtures thereof.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In one example, a gas burner includes a burner body and a simmer plate assembly. The burner body includes a central cavity in which at least one flame is provided. The simmer plate assembly includes a plate portion and a base portion configured to support the plate portion. The assembly is configured to be at least partially and removably inserted into the central cavity. The plate portion is configured to act as a barrier between the at least one flame and a heated object placed above the gas burner.

According to another example, a gas burner for a cooking appliance is provided. The gas burner comprises: a burner body comprising a plurality of flame ports therein; a burner cap provided on a top portion of the burner body; and a simmer plate positioned above the burner cap and being removably attached to the burner body.

According to yet another example, a gas burner for a cooking appliance is provided. The gas burner comprises: a burner body comprising a central cavity and having a plurality of flame ports provided through a wall of the burner body; a central burner positioned within the central cavity, the central burner having at least one aperture to form a central flame ring; a simmer plate assembly having a plate portion positioned above the central burner and a base portion positioned within the central cavity of the burner body, the base portion having an interlocking member for removably securing the simmer plate assembly to the burner body.

BRIEF DESCRIPTION OF THE DRAWINGS

The foregoing and other aspects of the present invention will become apparent to those skilled in the art to which the present invention relates upon reading the following description with reference to the accompanying drawings.

DETAILED DESCRIPTION

Figure 1:
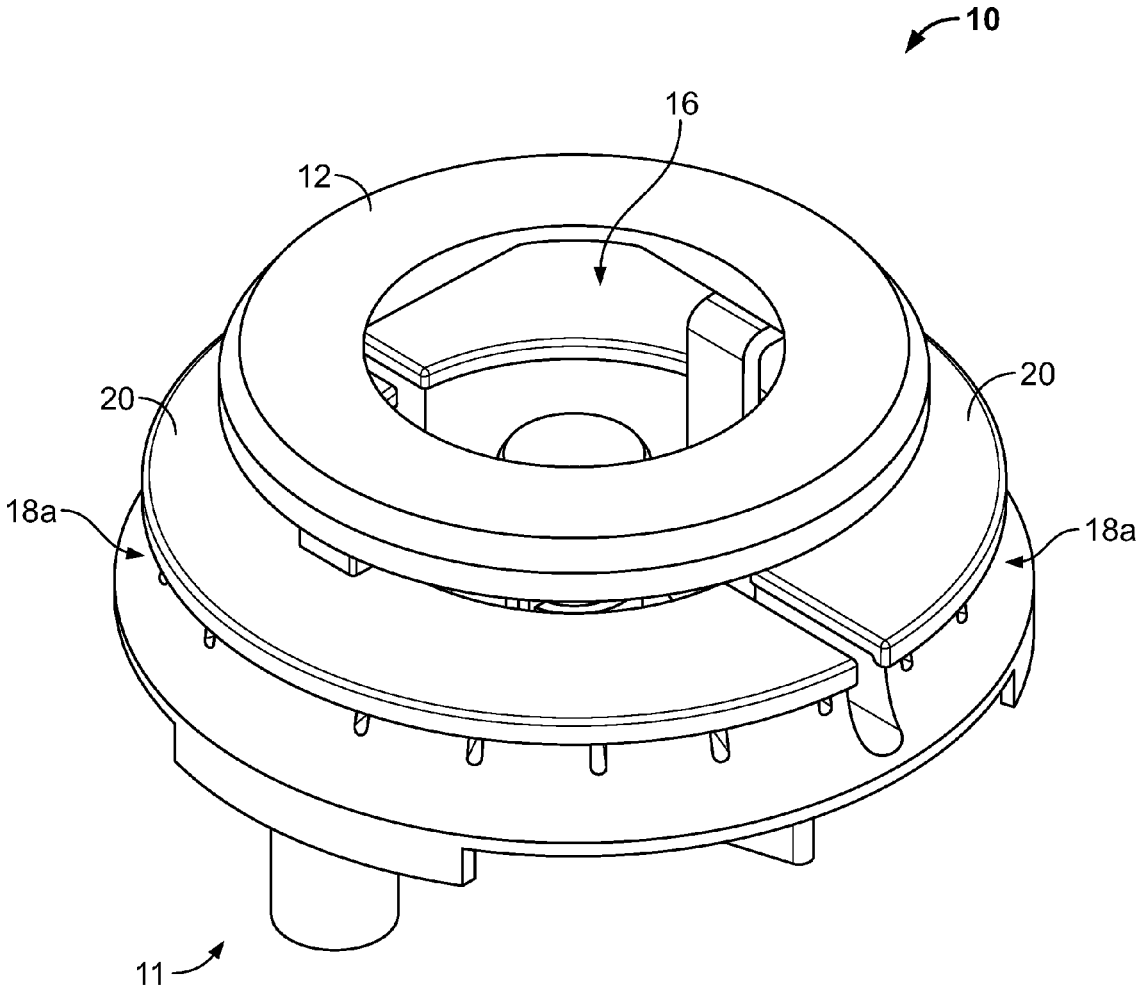
FIG. 1 is a perspective view of a gas burner with a first example embodiment of a simmer plate assembly.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Turning to the shown example of FIG. 1, a gas burner 10 for a cooking appliance, such as a gas cooktop, range, etc. is illustrated. FIG. 1 provides a top perspective view of the gas burner 10 having a burner body 11 and a simmer plate assembly 12. The burner body 11 includes at least one burner cap 20 positioned at a top portion of the burner body 11. As shown in FIG. 1, the simmer plate assembly 12 can include a substantially transparent central portion such that a user can view a central cavity 16 of the gas burner 10. As will be discussed in greater detail below, the simmer plate assembly is removably coupled to the burner body 11 such that the gas burner 10 can be used in a conventional cooking mode or in a simmer mode, as desired.

Figure 2:
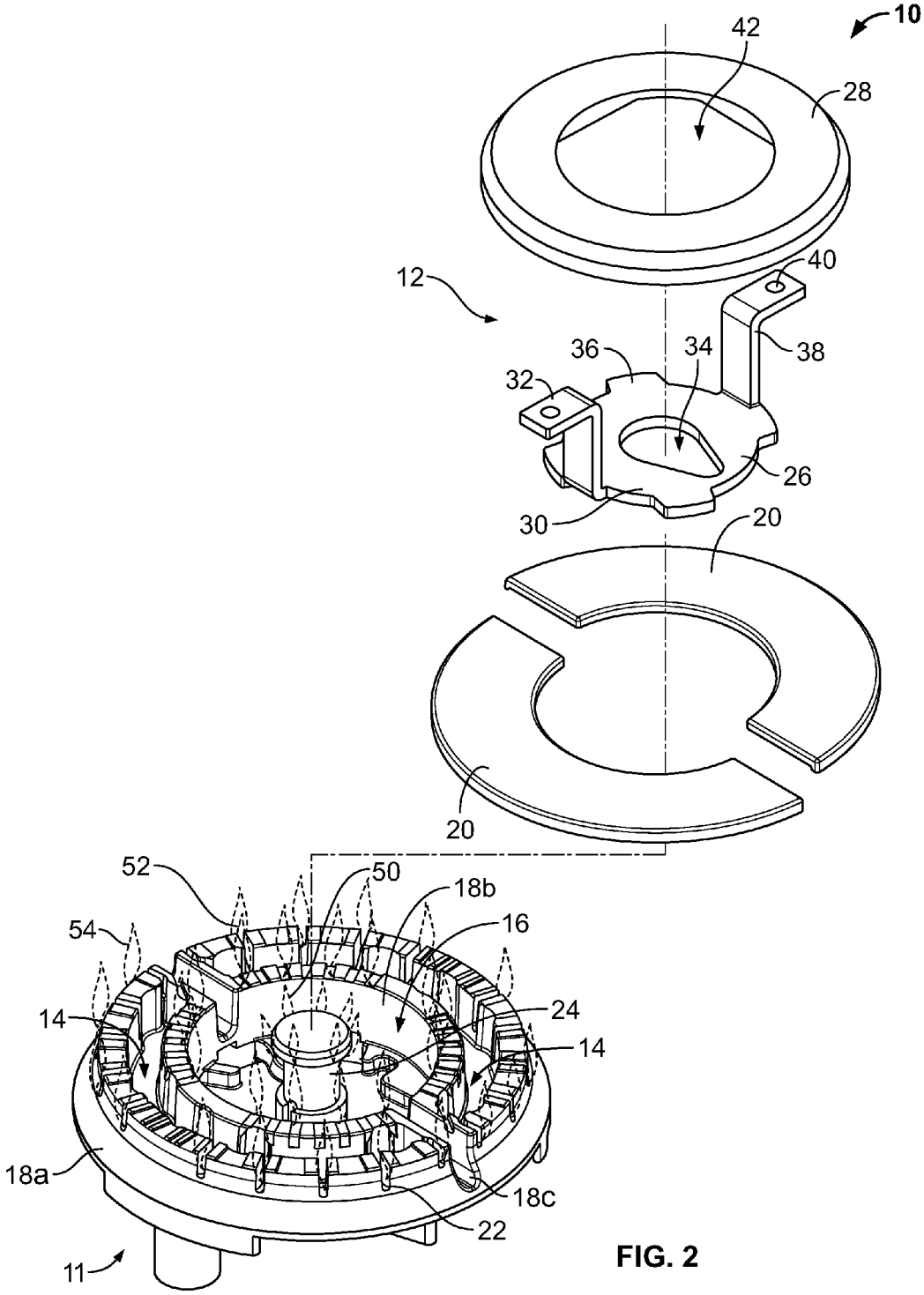
FIG. 2 is an exploded view of the gas burner with the first example simmer plate assembly.

FIG. 2 illustrates an exploded view of the gas burner 10 depicted in FIG. 1. The gas burner 10 may include two substantially symmetrical, semi-annular chambers 14 that surround a central cavity 16. Each chamber 14 is enclosed by a base, side walls 18 and a semi-annular burner cap 20 to form an interior space that is in communication with a gas source (not shown), which provides combustible gas to the interior space to create a gas-air mixture. The side walls can be divided into outer side walls 18*a* on the exterior of the gas burner 10, inner side walls 18*b* neighboring the central cavity 16 and intermediate walls 18*c* connecting the outer side wall 18*a* and the inner side wall 18*b*.

Both the outer and inner side walls 18*a*, 18*b* include ports 22 that are located at intervals and are provided through walls 18*a* and 18*b*. Intermediate walls 18*c* may include ports provided through a top portion thereof, as desired. The ports 22 are provided to allow the gas-air mixture to exit chambers 14. This gas-air mixture is ignited by an igniting device (not shown) such as an ignition electrode. Accordingly, the configuration of the burner shown provides three distinct flame rings. There is at least one central flame, such as a first flame ring 50, provided within the central cavity 16, as will be described in further detail below. An inner or second flame ring 52 can be formed inwardly of the inner walls 18*b* and an outer or third flame ring 54 can be formed outwardly of the outer walls 18*a*. It is to be appreciated that the burner configuration described herein is only exemplary. In another embodiment, the burner body 11 may have an annular-shape with an inner side wall 18*b* and an outer side wall 18*a* such that the chamber 14 is annular-shaped. Also, the flame rings may have different diameters, allowing a different distributed application of heat to a heated object.

The first flame ring 50 is formed by a central burner 24, which can be used as a simmer burner. In one example, the central burner 24 can be separate from the semi-annular chambers 14 and is independently supplied with combustible gas via a third gas supply, though could also share a gas supply. The central burner 24 can be formed together with the burner body 11, or can be coupled to the burner body 11 in various manners, such as by a clip ring or in various other removable or non-removable manners. In another example, the central burner 24 could be coupled to or formed with a mounting base. The central burner 24 includes at least one port or aperture to form the first flame ring. In the shown example, the central burner 24 can include a plurality of apertures, such as two or four or more, arranged generally equally around the perimeter thereof. The apertures can have various structure and/or configurations as previously described with respect to the burner ports 22. In general, the central burner apertures are configured to output a relatively small flame ring with relatively less heat output as compared to the second, inner flame ring. The central burner flame ring can be generally concentric with the inner flame ring, and can have a relatively smaller diameter.

The gas burner 10 further includes a simmer plate assembly 12. The simmer plate assembly 12 includes a base portion 26 and a plate portion 28 that is coupled to the base portion 26. The base portion 26 is configured to support the plate portion 28 when coupled with the burner body 11 of the gas burner 10. The base portion 26 comprises a base plate 30 and support brackets 32. The simmer plate assembly 12 is configured to be at least partially and removably inserted into the central cavity 16 of the gas burner 10. The plate portion 28 is configured to act as a barrier between the at least one flame and a heated object placed above the gas burner 10. The heated object may include pots, pans, other cooking utensils, food, or any other object that a user intends to heat.

Figure 3A:
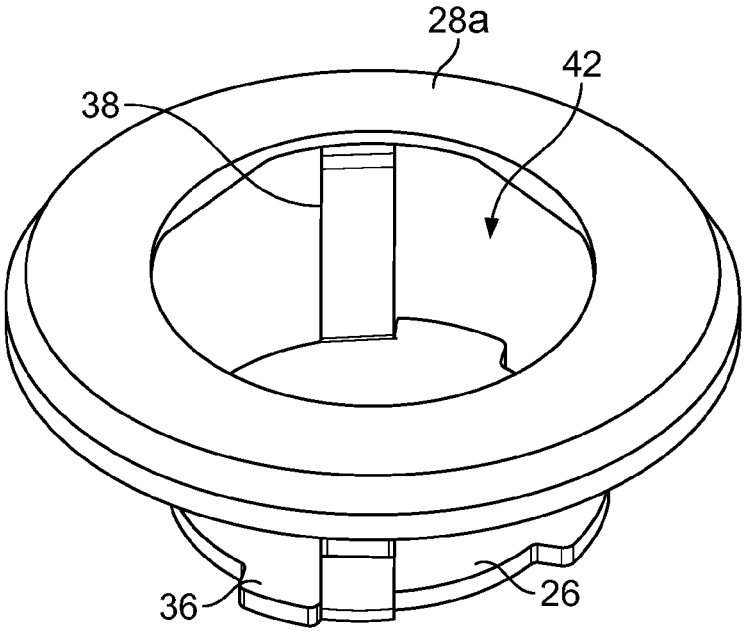
FIG. 3A is a perspective view of the first example simmer plate assembly.
Figure 3B:
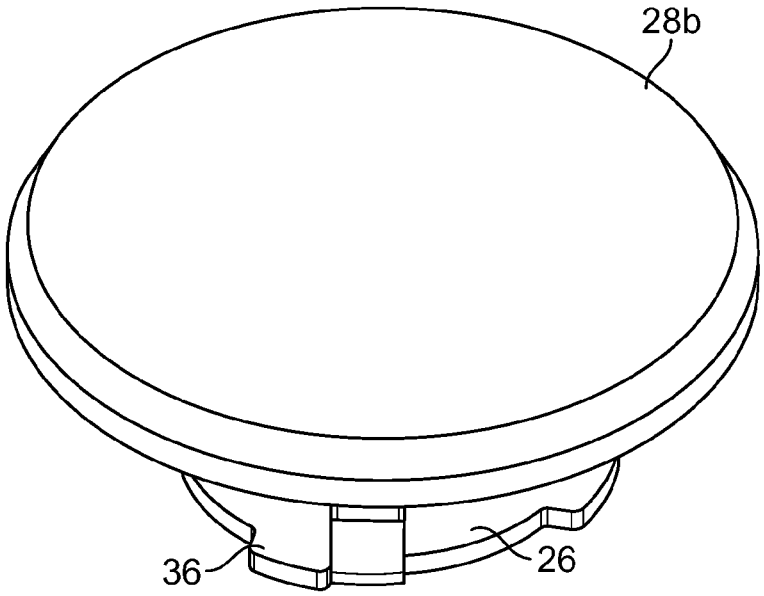
FIG. 3B is a perspective view of a second example embodiment of the simmer plate assembly.
Figure 4:
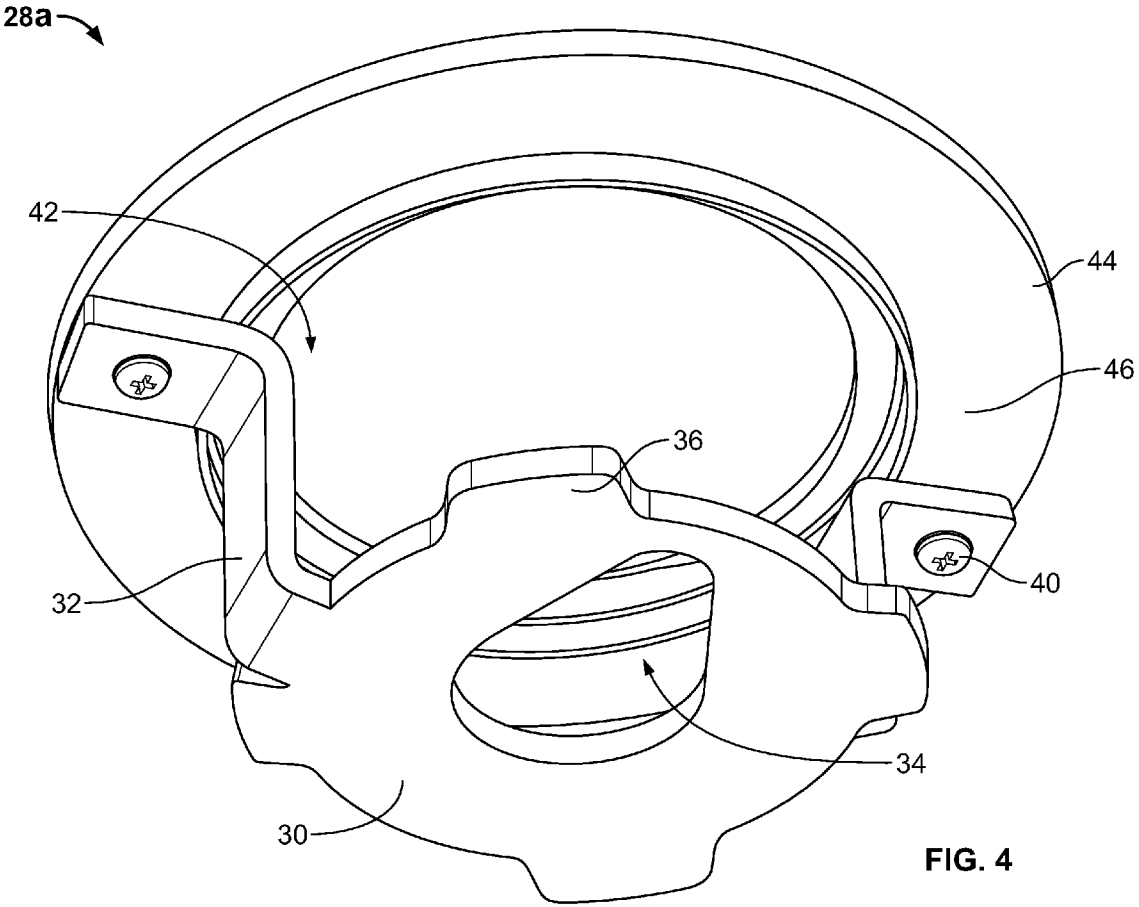
FIG. 4 is a perspective view from below of the first example simmer plate assembly.
Figure 5:
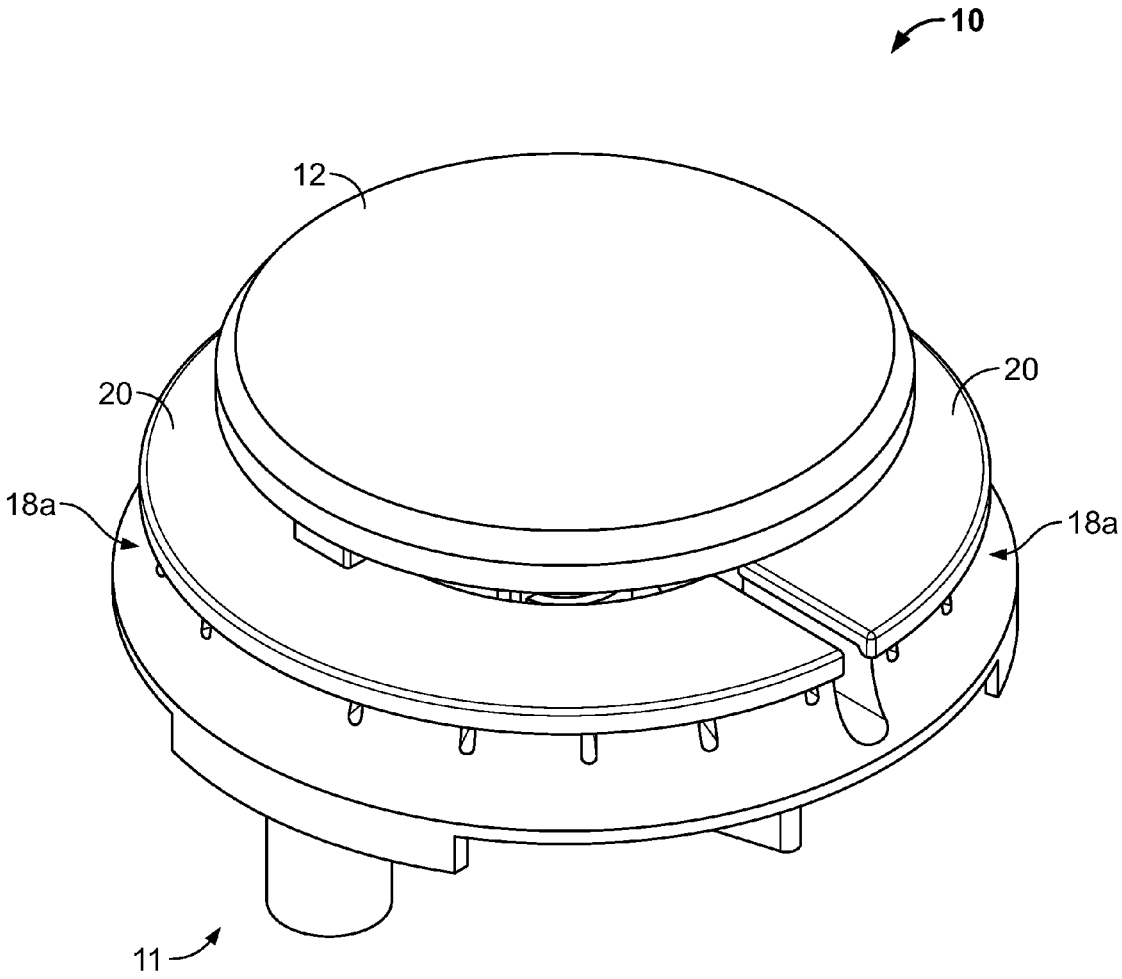
FIG. 5 is a perspective view of a gas burner with the second example simmer plate assembly.

Referring now to FIGS. 3A and 3B, two examples of the simmer plate assembly 12 with different configurations of the plate portion 28 are shown. The plate portion 28 is a disk-shaped component that may be beveled along the circumference. The first example shown in FIG. 3A includes a centrally-disposed, clear portion that may be formed by a disk 42, which allows a user to view at least the central flame ring 50. This embodiment also includes an annular shaped plate portion 28*a* that surrounds the transparent disk 42. The disk 42 can be made of heat resistant material such as ceramic. As shown in FIG. 4, a lower surface 44 of the plate portion 28*a* can include a recessed area 46 in which the disk 42 may fit and be secured by the support brackets 32 when the support brackets are fastened to the plate portion 28. In the example shown in FIG. 3B, the plate portion 28*b* is formed from a single material such as metal, alloys, ceramic, or any other material suitable for burner construction as is known in the art.

The presence of the plate portion 28 within the central cavity and positioned over the central burner 24 acts as a barrier between the inner flame ring and the central flame ring and an object provided on the gas burner 10. Thus, the intensity of heating provided by the gas burner 10 can be lowered for low heat-type cooking, such as a simmer mode heating, by using the simmer plate assembly 12 and can be raised for a high heat type cooking by removing the simmer plate assembly 12. Although not shown, it may be possible to provide other embodiments of the plate portion 28 with or without the clear portion that offer various degrees of simmer mode heating through variation in thickness, material properties, etc.

Although the simmer plate assembly 12 has been shown and described as being made of two or three different components, it is to be appreciated that the simmer plate assembly could be composed of a single component, or of more than three components.

Turning now to FIG. 4, the base portion 26 includes a base plate 30 and support brackets 32 extending upward from the base plate 30 to support the plate portion 28. The support brackets 32 may be L-shaped and can be materially integral with the base plate 30. As illustrated, the support brackets 32 are outwardly flared at a first end portion thereof and the plate portion 28 is supported by the outwardly flared portions which include apertures 40 for a fastener, such as a screw or the like, to fasten the base portion 26 with the plate portion 28.

As discussed herein, the burner body 11 of the gas burner 10 includes a central burner 24 within the central cavity 16. The base plate 30 of the simmer plate assembly 12 includes an aperture 34 for allowing the central burner 24 to pass therethrough as the simmer plate assembly 12 is inserted into the central cavity 16. The base plate 30 is dimensioned to fit within the central cavity 16. The aperture 34 is shaped to accommodate the shape of the central burner 24 and may create a sliding fit between the central burner 24 and the aperture 34. The shape of the aperture 34 may also determine the manner in which the base plate 30 should be oriented relative to the central burner 24 when the simmer plate assembly 12 is placed within the central cavity 16. For example, the base plate 30 may be configured to reach the bottom of the central cavity 16 only when the base plate 30 is oriented in a specific orientation relative to the central cavity 16.

The base portion 26 of the simmer plate assembly 12 may include a first interlock element 36 and the burner body 11 including a second interlock element configured to interlock with the first interlock element 36. For example, the first interlock element 36 may be tabs 36 which may become interlocked with features in the central cavity 16, such as slots in which the tabs 36 can be accommodated, for immobilization through rotation in one direction and may become unlocked for removal through rotation in one direction and may become unlocked for removal through rotation in the other direction. Alternatively, the base portion 26 may be without the first interlock element 36 and the burner body 11 may be without the second interlock element to encourage smooth insertion and removal of the simmer plate assembly 12 into and out of the central cavity 16. Moreover, the aperture 34 of the simmer plate assembly 12 and the burner body 11 may be configured such that the base portion 26 is mounted within the central cavity 16 by assuming a predetermined orientation. Specifically, the aperture 34 may be keyed so that the base plate 30 can reach the bottom of the central cavity 16 when approaching the central burner 24 at a specific orientation.

The use of the simmer plate assembly 12 allows the gas burner 10 to operate as a normal burner providing high intensity range heat or as a simmer burner providing a lower intensity range heat. The simmer plate assembly 12 can be slidingly engaged with the burner 10 by hand and immobilized in place with a twist of the simmer plate assembly 12.

For example, if the burner 10 has been in use at a high setting, a user can switch to an effective simmer mode by placing the simmer plate assembly 12 in the central cavity 16 and engaging the tabs 36 with corresponding features in the central cavity 16. Naturally, if the temperature of the simmer plate assembly 12 is elevated, it may be best to use tongs or other tools to handle the simmer plate assembly 12 to avoid burns. Otherwise, no fastening tools are required to insert or remove the simmer plate assembly 12 and hold it in place.

The invention has been described with reference to the example embodiments described above. Modifications and alterations will occur to others upon a reading and understanding of this specification. Example embodiments incorporating one or more aspects of the invention are intended to include all such modifications and alterations.

What is claimed is:

1. A gas burner including:

a burner body including a central cavity in which at least one flame is provided by a central burner; and a simmer plate assembly configured to be at least partially and removably inserted into the central cavity, the simmer plate assembly including a plate portion and a base portion, the base portion being configured to support the plate portion, the base portion including a base plate, the base plate including an aperture, the aperture being configured to allow the central burner to pass therethrough as the simmer plate assembly is inserted into the central cavity, the plate portion being configured to act as a barrier between the at least one flame and an object placed above the gas burner.

2. The gas burner of claim 1, the plate portion including a transparent disk for viewing the central cavity.

3. The gas burner of claim 1, the plate portion including a translucent disk for viewing the central cavity.

4. The gas burner of claim 1, the base portion further including support brackets extending upward from the base plate to support the plate portion.

5. The gas burner of claim 1, the central burner providing a first flame within the central cavity.

6. The gas burner of claim 1, the aperture and the burner body being configured such that the base portion is mounted within the central cavity by assuming a predetermined orientation.

7. The gas burner of claim 1, the burner body being annular-shaped with an inner side wall and an outer side wall.

8. The gas burner of claim 1, the central burner forming a first flame ring within the central cavity.

9. The gas burner of claim 8, the burner body being annular-shaped with an inner side wall, the inner side wall including inner ports along a top thereof, the inner ports forming a second flame ring.

10. The gas burner of claim 9, the burner body further including an outer side wall, the outer side wall including outer ports along a top thereof, the outer ports forming a third flame ring.

11. A gas burner for a cooking appliance, the gas burner comprising:

a burner body comprising a plurality of flame ports therein;

a central burner surrounded by the flame ports within a center of the burner body; and a simmer plate having a plate portion and a base portion connected to the plate portion, the plate portion being positioned above the central burner, the base portion having an aperture configured to allow the central burner to pass therethrough, the base portion having an interlocking member for removably securing the base portion to the central burner.

12. The gas burner of claim 11, wherein the plate portion is removably attached to the base portion by a support bracket.

13. The gas burner of claim 12, wherein the simmer plate is removably attached to the central burner by the base portion attached to the support bracket.

14. The gas burner of claim 13, wherein the base portion includes tabs configured to interlock with corresponding features in the central burner.

15. The gas burner of claim 11, wherein the simmer plate includes a substantially transparent disk through which a flame emitted from the burner body can be viewed.

16. The gas burner of claim 11, wherein the simmer plate is concentrically positioned on the burner body and has a diameter that is smaller than an outer diameter of the burner body.

17. A gas burner for a cooking appliance, the gas burner comprising:

a burner body comprising a central cavity and having a plurality of flame ports provided through a wall of the burner body;

a central burner positioned within the central cavity, the central burner having at least one aperture to form a central flame ring;

a simmer plate assembly having a plate portion positioned above the central burner and a base portion positioned within the central cavity of the burner body, the base portion having an interlocking member for removably securing the simmer plate assembly to the central burner.

18. The gas burner of claim 17, wherein the plate portion includes a substantially transparent disk in a center portion thereof.

19. The gas burner of claim 17, wherein the burner body includes at least one annular chamber having flame ports provided through an inner and outer wall of the chamber.

20. The gas burner of claim 17, wherein the burner body includes two semi-annular chambers, each semi-annular chamber including an inner wall, an outer wall, and an intermediate wall, at least the inner and outer wall having flame ports provided therethrough.

* * * * *